US007562999B2

(12) United States Patent
Chen

(10) Patent No.: US 7,562,999 B2
(45) Date of Patent: Jul. 21, 2009

(54) OPERATING LAMP WITH ADJUSTABLE LIGHT SOURCES CAPABLE OF GENERATING A LIGHT FIELD OF A GAUSSIAN DISTRIBUTION

(75) Inventor: Lien-Chen Chen, Taoyuan County (TW)

(73) Assignee: Mediland Enterprise Corporation, Lohshan Vill, Kueishan Hsiang, Taoyuan Hsien (TW)

( * ) Notice: Subject to any disclaimer, the term of this patent is extended or adjusted under 35 U.S.C. 154(b) by 27 days.

(21) Appl. No.: 11/870,429

(22) Filed: Oct. 11, 2007

(65) Prior Publication Data

US 2008/0247163 A1 Oct. 9, 2008

Related U.S. Application Data

(60) Provisional application No. 60/909,947, filed on Apr. 4, 2007.

(51) Int. Cl.
*F21V 11/00* (2006.01)

(52) U.S. Cl. ..... 362/239; 362/329; 600/248

(58) Field of Classification Search ..... 362/277, 362/237, 238, 239, 240, 329; 600/248, 249
See application file for complete search history.

(56) References Cited

U.S. PATENT DOCUMENTS

| | | | | |
|---|---|---|---|---|
| 4,220,981 | A * | 9/1980 | Koether | 362/486 |
| 6,152,577 | A * | 11/2000 | Rizkin et al. | 362/281 |
| 2005/0024886 | A1 * | 2/2005 | McKenzie et al. | 362/490 |
| 2007/0041167 | A1 | 2/2007 | Nachi | |

* cited by examiner

*Primary Examiner*—Jong-Suk (James) Lee
*Assistant Examiner*—Julie A Shallenberger
(74) *Attorney, Agent, or Firm*—Winston Hsu

(57) ABSTRACT

An operating lamp includes a center optical system, and a plurality of side optical systems. Each of the optical systems includes a plurality of light sources. Each of the light sources includes a condensing lens and an LED. When the positions of the condensing lens with respect to the LEDs are adjusted, the operating lamp is still able to generate a light field of a substantial Gaussian distribution. Thus the light intensity corresponding to the center of the operating lamp can still be optimized even when the light field is increased or decreased.

13 Claims, 17 Drawing Sheets

12-12'

OPERATING LAMP WITH ADJUSTABLE LIGHT SOURCES CAPABLE OF GENERATING A LIGHT FIELD OF A GAUSSIAN DISTRIBUTION

CROSS REFERENCE TO RELATED APPLICATIONS

This application claims the benefit of U.S. Provisional Application No. 60/909,947, filed on Apr. 4, 2007 and entitled "LIGHT SOURCE WITH AN ADJUSTABLE LED OR CONDENSING LENS," the contents of which are incorporated herein by reference.

BACKGROUND OF THE INVENTION

1. Field of the Invention

The present invention relates to an operating lamp, and more specifically, to an operating lamp with adjustable light sources capable of generating a light field of a Gaussian distribution.

2. Description of the Prior Art

In modern society, illumination devices have become indispensable in our daily life. In a dark environment, an illumination device is usually required for people to engage in certain activities, such as a surgical operation. Therefore, many auxiliary devices for providing light are manufactured accordingly. An optical system for surgical operation application is a representative example.

In general, a surgical operation requires optical systems having specific light-technological properties (for example, shadowless, luminescent, etc.). Thus, a prior art optical system comprises a plurality of light sources for fulfilling the requirements. Please refer to FIG. 1. FIG. 1 is a perspective view of an optical system 1 according to the prior art. The optical system 1 comprises a plurality of light sources 2, 3 (only three are shown in FIG. 1). As shown in FIG. 1, the light sources 3 are disposed around the light source 2 symmetrically, and each light source 3 is pivotally connected to the light source 2 so that the tilted angle of each light source 3 with respect to the light source 2 can be adjustable. Each of the light sources 2, 3 comprises an LED 4 and a condensing lens 5. A position of each LED 4 relative to the corresponding condensing lens 5 is fixed, and an optical axis of each LED 4 is aligned with an optical axis of the corresponding condensing lens 5 for providing a light field with a light intensity of a substantial Gaussian distribution in a target area.

During a surgical operation, a doctor usually needs to expand the light field to get a better vision of the target area. At this time, the doctor can adjust the tilted angle of the light sources 3 with respect to the light source 2 via rotating the light sources 3 relative to the light source 2 so as to change the light field diameter.

However, that will cause the light intensity distribution of the light field varying from the substantial Gaussian distribution to a non-Gaussian distribution in the target area due to the angle variation between the light source 2 and the light sources 3. Thus, although the light field can be expanded to a desirable size via adjusting the tilted angle of the light sources 3 with respect to the light source 2, the center light intensity of the light field is greatly reduced accordingly because the distribution of the light field is no longer substantially Gaussian.

SUMMARY OF THE INVENTION

The present invention provides an operating lamp comprising a center optical system comprising a first casing; a first pulley installed on the first casing; and a plurality of light sources accommodated in the first casing; a plurality of side optical systems each comprising a second casing fixed on the first casing; a disk body movably accommodated in the second casing; a plurality of condensing lenses fixed on the disk body for moving together with the disk body; a plurality of light emitting diodes disposed above the plurality of condensing lenses respectively and fixed on the second casing; a lead screw connected to the second casing in a coaxial manner; a second pulley meshed with the lead screw for moving downward or upward on the lead screw when rotated; a rod abutting against the disk body and the second pulley for pushing the disk body to move downward when the second pulley is rotated downward; and a spring connected to the second casing and the disk body for pulling the disk body to move upward when the second pulley is rotated upward; a motor mounted on the first casing; a plurality of third pulleys; a gear wheel mounted on the motor and disposed next to the first pulley for meshing with the first pulley; and a gear belt disposed along the first pulley, second pulleys of side optical systems and third pulleys for meshing with the first pulley and the second pulleys and engaging with the third pulleys for causing each disk body to move upward or downward with the corresponding second pulley when the motor drives the gear wheel.

The present invention further provides a surgical optical system comprising a casing and a plurality of light sources accommodated in the casing, each of the light sources comprising an LED and a condensing lens. A position of the LED relative to the condensing lens is changeable.

The present invention further provides a light source comprising an LED and a condensing lens. A position of the LED relative to the condensing lens is changeable.

These and other objectives of the present invention will no doubt become obvious to those of ordinary skill in the art after reading the following detailed description of the preferred embodiment that is illustrated in the various figures and drawings.

DETAILED DESCRIPTION

An embodiment of the present invention introduces a light source comprising an LED and a condensing lens. The condensing lens can be a positive lens or a collimator.

Figure 1:
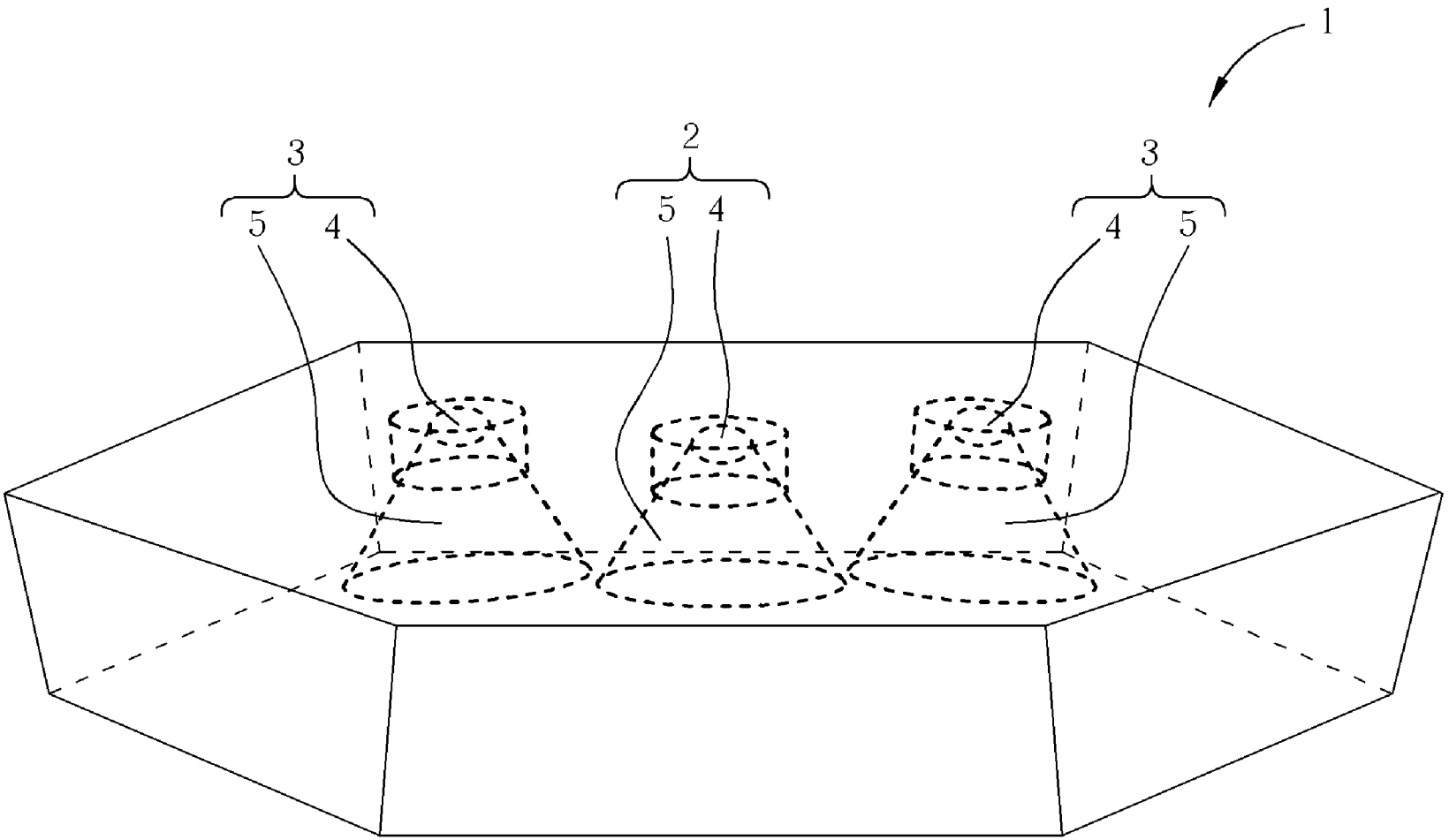
Fig. 1 Prior Art
FIG. 1 is a perspective view of an operating lamp according to the prior art.
Figure 2:
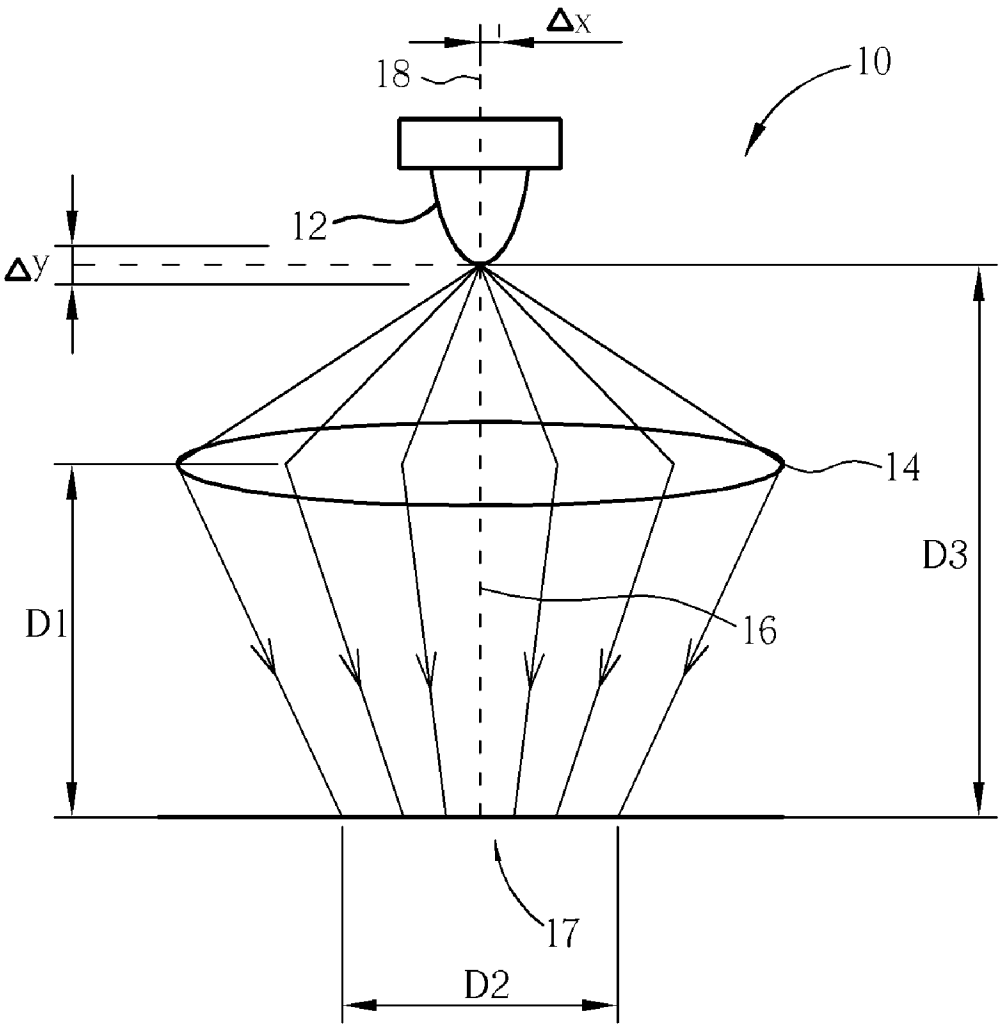
FIG. 2 is a perspective view of a light source according to first to sixth embodiments of the present invention.
Figure 3:
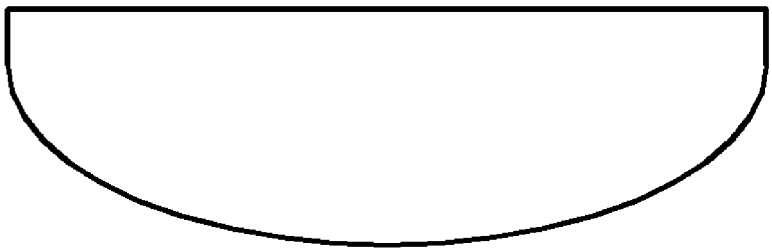
FIGS. 3 and 4 are diagrams of positive lenses according to the present invention.
Figure 4:
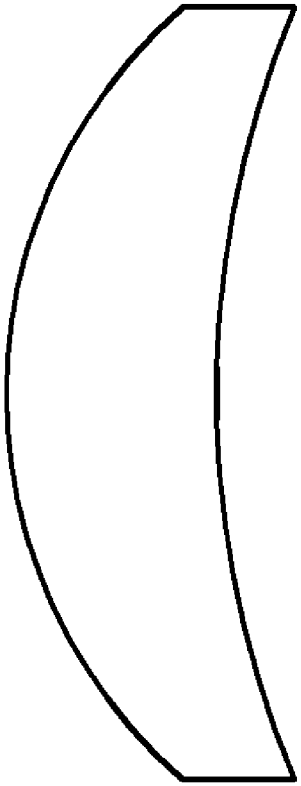

Please refer to FIG. 2. FIG. 2 is a perspective view of a light source 10 according to first to sixth embodiments of the present invention. The light source 10 comprises an LED 12 and a positive lens 14 disposed next to the LED 12 for condensing light emitted by the LED 12. The positive lens 14 can be a biconvex lens shown in FIG. 2, a plano-convex lens shown in FIG. 3, a positive meniscus lens shown in FIG. 4, etc. for converging light. The LED 12 is disposed at or near the focus of the positive lens 14.

In the first embodiment, the positive lens 14 is fixed, which implies that the distance D1 between the positive lens 14 and a target area 17 is fixed, but the LED 12 is adjustable along a line in parallel to an optical axis 16 of the positive lens 14 and thus can be moved towards the positive lens 14 or away from the positive lens 14. When the LED 12 is moved closer to the positive lens 14, the light field diameter D2 increases. When the LED 12 is moved away from the positive lens 14, the light field diameter D2 decreases. In this embodiment, the optical axis 18 of the LED 12 can be aligned with the optical axis 16 or misaligned with the optical axis 16.

In the second embodiment, the LED 12 is adjustable along a line in perpendicular with the optical axis 16 of the positive lens 14, but the positive lens 14 is fixed, which implies that the distance D1 between the positive lens 14 and a target area 17 is fixed. When the optical axis 18 of the LED 12 is moved closer to the optical axis 16 of the positive lens 14, the center of the light field is moved closer to the optical axis 16 of the positive lens 14, and the light field diameter D2 decreases. When the optical axis 18 of the LED 12 is moved further away from the optical axis 16 of the positive lens 14, the center of the light field is moved further away from the optical axis 16 of the positive lens 14, and the light field diameter D2 increases. When the LED 12 is shifted leftward, the light field is shifted rightward. When the LED 12 is shifted rightward, the light field is shifted leftward. When the optical axis 18 of the LED 12 is at the left side of the optical axis 16 of the positive lens 14, the center of the light field is at the right side of the optical axis 16 of the positive lens 14. When the optical axis 18 of the LED 12 is at the right side of the optical axis 16 of the positive lens 14, the center of the light field is at the left side of the optical axis 16 of the positive lens 14.

In the third embodiment, the positive lens 14 is fixed, which implies that the distance D1 between the positive lens 14 and a target area 17 is fixed. The LED 12 is adjustable along a line in parallel to the optical axis 16 of the positive lens 14 and adjustable along a line in perpendicular with the optical axis 16 of the positive lens 14. A change of the distance between the LED 12 and the positive lens 14 changes the light field diameter D2. A rightward or leftward shift of the LED 12 shifts the light field in an opposite direction and changes the light field diameter D2.

In the fourth embodiment, the LED 12 is fixed, which implies that the distance D3 between the LED 12 and the target area 17 is fixed, but the positive lens 14 is adjustable along a line in parallel to the optical axis 16 of the positive lens 14 and thus can be moved towards the LED 12 or away from the LED 12. When the positive lens 14 is moved closer to the LED 12, the light field diameter D2 increases. When the positive lens 14 is moved away from the LED 12, the light field diameter D2 decreases. In this embodiment, the optical axis 18 of the LED 12 can be aligned with the optical axis 16 or misaligned with the optical axis 16.

In the fifth embodiment, the positive lens 14 is adjustable along a line in perpendicular with the optical axis 16 of the positive lens 14, but the LED 12 is fixed, which implies that the distance D3 between the LED 12 and the target area 17 is fixed. When the optical axis 16 of the positive lens 14 is moved closer to the optical axis 18 of the LED 12, the center of the light field is moved closer to the optical axis 16 of the positive lens 14, and the light field diameter D2 decreases. When the optical axis 16 of the positive lens 14 is moved further away from the optical axis 18 of the LED 12, the center of the light field is moved further away from the optical axis 16 of the positive lens 14, and the light field diameter D2 increases. When the positive lens 14 is shifted leftward, the light field is shifted leftward. When the positive lens 14 is shifted rightward, the light field is shifted rightward. When the optical axis 18 of the LED 12 is at the left side of the optical axis 16 of the positive lens 14, the center of the light field is at the right side of the optical axis 16 of the positive lens 14. When the optical axis 18 of the LED 12 is at the right side of the optical axis 16 of the positive lens 14, the center of the light field is at the left side of the optical axis 16 of the positive lens 14.

In the sixth embodiment, the positive lens 14 is adjustable along a line in parallel to the optical axis 16 of the positive lens 14 and adjustable along a line in perpendicular with an optical axis 16 of the positive lens 14, but the LED 12 is fixed, which implies that the distance D3 between the LED 12 and the target area 17 is fixed. A change of the distance between the LED 12 and the positive lens 14 changes the light field diameter D2. A rightward or leftward shift of the positive lens 14 shifts the light field in the same direction and changes the light field diameter D2.

Figure 5:
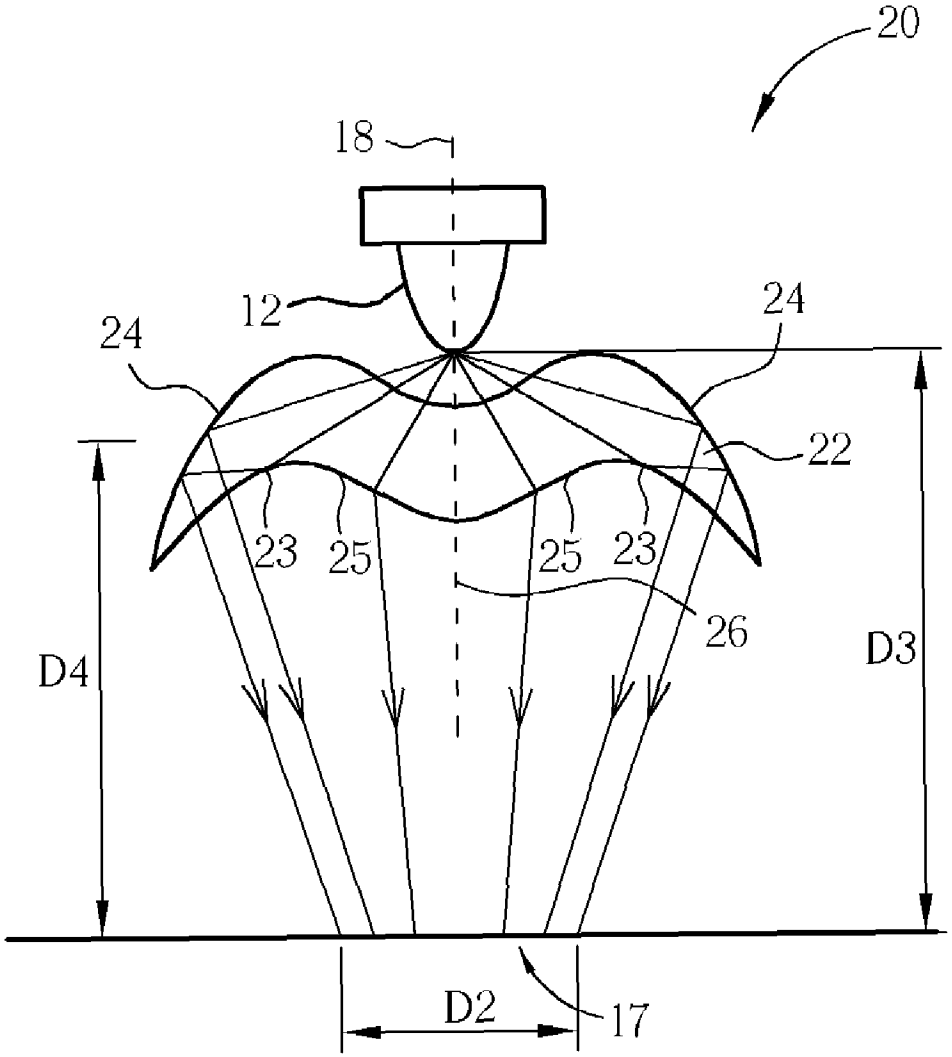
FIG. 5 is a perspective view of a light source according to seventh to twelfth embodiments of the present invention.

Please refer to FIG. 5. FIG. 5 is a perspective view of a light source 20 according to seventh to twelfth embodiments of the present invention. The light source 20 comprises an LED 12 and a collimator 22 disposed next to the LED 12 for condensing light emitted by the LED 12. The collimator 22 has coated surfaces 24 for reflecting light emitted from the LED 12, surfaces 23 for reflecting light, and surfaces 25 for refracting light. The LED 12 is disposed at or near the focus of the collimator. And the surfaces 23 are total internal reflection surfaces for light emitted thereon from the LED 12.

In the seventh embodiment, the collimator 22 is fixed, which implies that the distance D4 between the collimator 22 and a target area 17 is fixed, but the LED 12 is adjustable along a line in parallel to an optical axis 26 of the collimator 22 thus can be moved towards the collimator 22 or away from the collimator 22. When the LED 12 is moved closer to the collimator 22, the light field diameter D2 increases. When the LED 12 is moved away from the collimator 22, the light field diameter D2 decreases. In this embodiment, the optical axis 18 of the LED 12 can be aligned with the optical axis 26 or misaligned with the optical axis 26.

In the eighth embodiment, the LED 12 is adjustable along a line in perpendicular with the optical axis 26 of the collimator 22, but the collimator 22 is fixed, which implies that the distance D4 between the collimator 22 and a target area 17 is fixed. When the optical axis 18 of the LED 12 is moved closer to the optical axis 26 of the collimator 22, the center of the light field is moved closer to the optical axis 26 of the collimator 22, and the light field diameter D2 decreases. When the optical axis 18 of the LED 12 is moved further away from the optical axis 26 of the collimator 22, the center of the light field is moved further away from the optical axis 26 of the collimator 22, and the light field diameter D2 increases. When the LED 12 is shifted leftward, the light field is shifted rightward. When the LED 12 is shifted rightward, the light field is shifted leftward. When the optical axis 18 of the LED 12 is at the left side of the optical axis 26 of the collimator 22, the center of the light field is at the right side of the optical axis 26 of the collimator 22. When the optical axis 18 of the LED 12 is at the right side of the optical axis 26 of the collimator 22, the center of the light field is at the left side of the optical axis 26 of the collimator 22.

In the ninth embodiment, the collimator 22 is fixed, which implies that the distance D4 between the collimator 22 and a target area 17 is fixed. The LED 12 is adjustable along a line in parallel to the optical axis 26 of the collimator 22 and adjustable along a line in perpendicular with the optical axis 26 of the collimator 22. A change of the distance between the LED 12 and the collimator 22 changes the light field diameter D2. A rightward or leftward shift of the LED 12 shifts the light field in an opposite direction and changes the light field diameter D2.

In the tenth embodiment, the LED 12 is fixed, which implies that the distance D3 between the LED 12 and the target area 17 is fixed, but the collimator 22 is adjustable along a line in parallel to the optical axis 26 of the collimator 22 thus can be moved towards the LED 12 or away from the LED 12. When the collimator 22 is moved closer to the LED 12, the light field diameter D2 increases. When the collimator 22 is moved away from the LED 12, the light field diameter D2 decreases. In this embodiment, the optical axis 18 of the LED 12 can be aligned with the optical axis 26 or misaligned with the optical axis 26.

In the eleventh embodiment, the collimator 22 is adjustable along a line in perpendicular with the optical axis 26 of the collimator 22, but the LED 12 is fixed, which implies that the distance D3 between the LED 12 and the target area 17 is fixed. When the optical axis 26 of the collimator 22 is moved closer to the optical axis 18 of the LED 12, the center of the light field is moved closer to the optical axis 26 of the collimator 22, and the light field diameter D2 decreases. When the optical axis 26 of the collimator 22 is moved further away from the optical axis 18 of the LED 12, the center of the light field is moved further away from the optical axis 26 of the collimator 22, and the light field diameter D2 increases. When the collimator 22 is shifted leftward, the light field is shifted leftward. When the collimator 22 is shifted rightward, the light field is shifted rightward. When the optical axis 18 of the LED 12 is at the left side of the optical axis 26 of the collimator 22, the center of the light field is at the right side of the optical axis 26 of the collimator 22. When the optical axis 18 of the LED 12 is at the right side of the optical axis 26 of the collimator 22, the center of the light field is at the left side of the optical axis 26 of the collimator 22.

In the twelfth embodiment, the collimator 22 is adjustable along a line in parallel to the optical axis 26 of the collimator 22 and adjustable along a line in perpendicular with an optical axis 26 of the collimator 22, but the LED 12 is fixed, which implies that the distance D3 between the LED 12 and the target area 17 is fixed. A change of the distance between the LED 12 and the collimator 22 changes the light field diameter D2. A rightward or leftward shift of the collimator 22 shifts the light field in the same direction and changes the light field diameter D2.

Figure 6A:
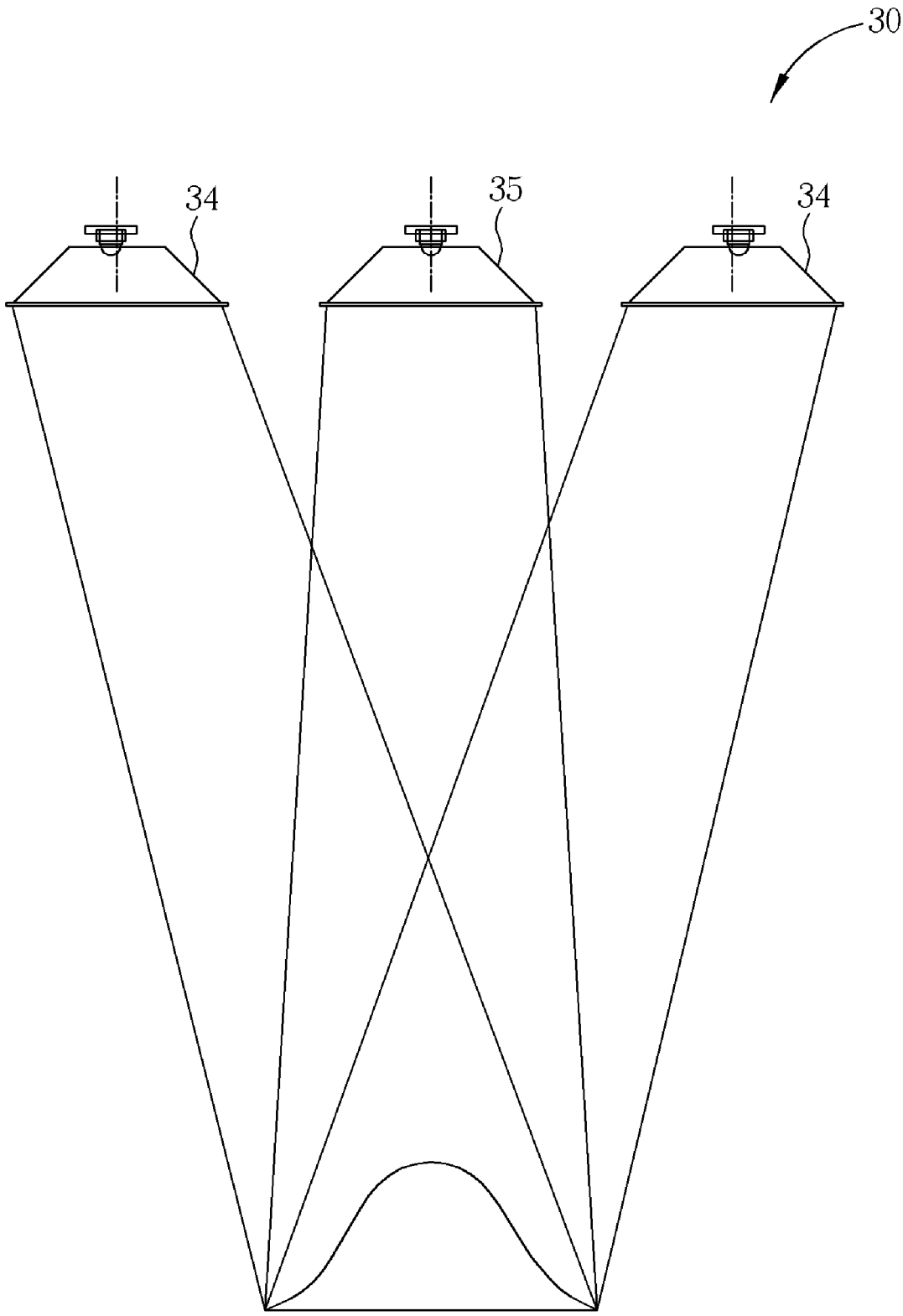
FIG. 6A is a perspective view of a surgical optical system according to the thirteenth embodiment of the present invention.
Figure 6B:
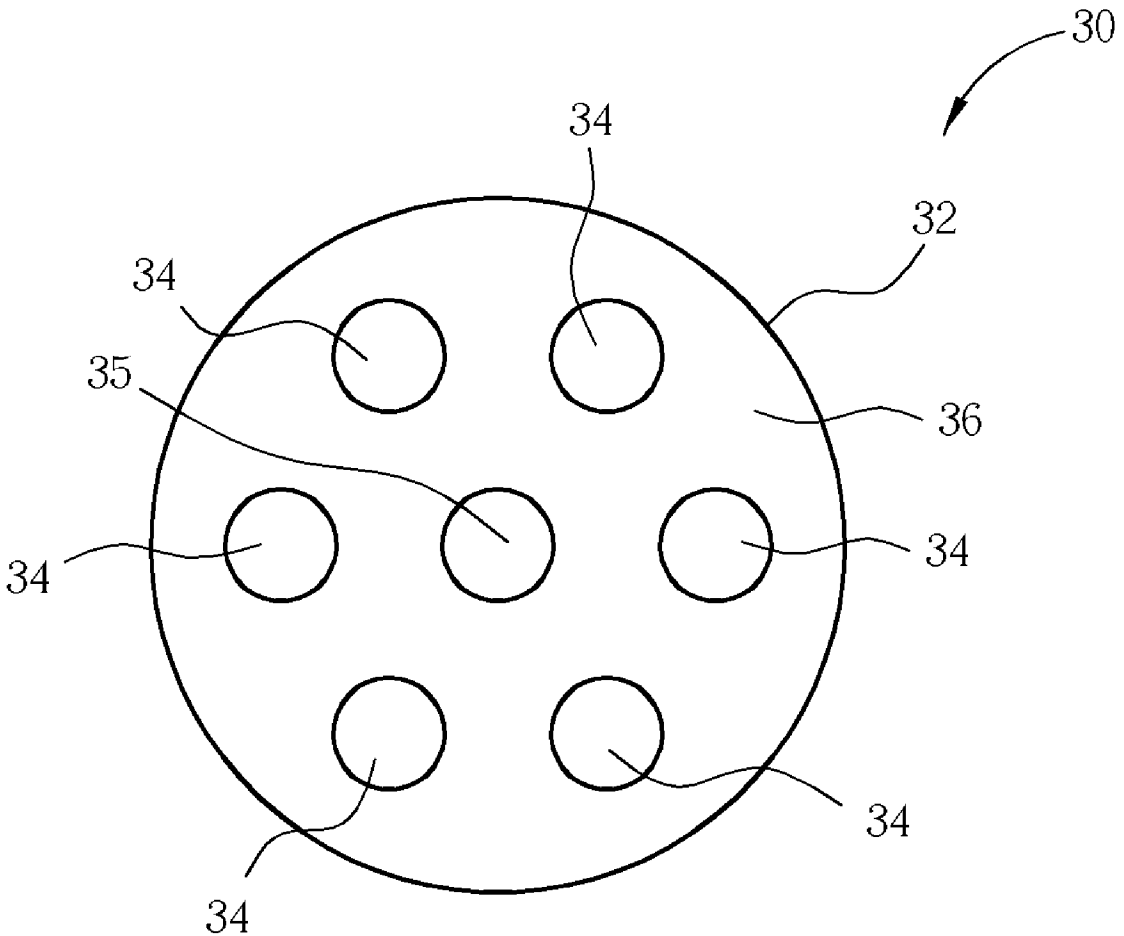
FIG. 6B is a bottom view of the surgical optical system in FIG. 6A.
Figure 7A:
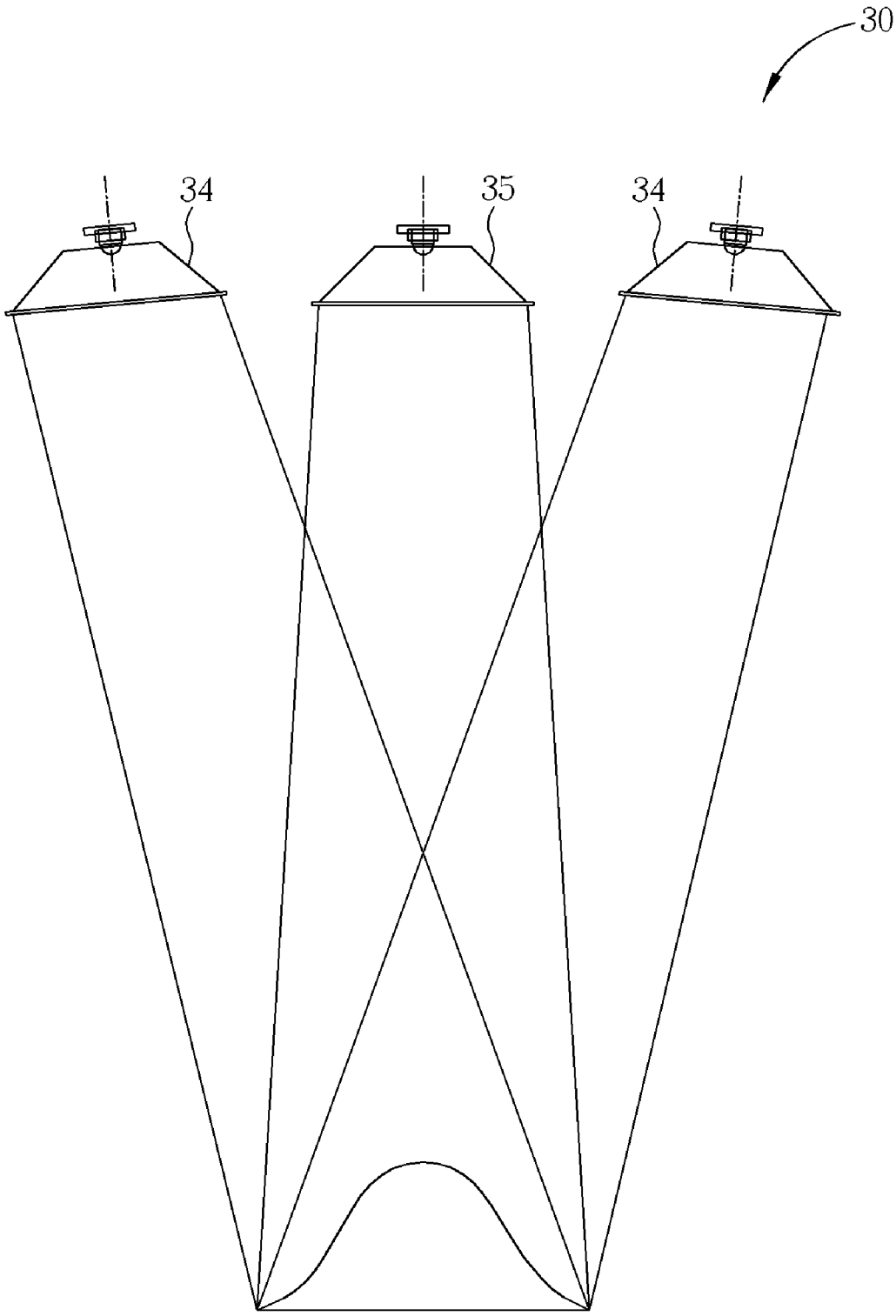
FIG. 7A is a perspective view of a surgical optical system according to the fourteenth embodiment of the present invention.
Figure 7B:
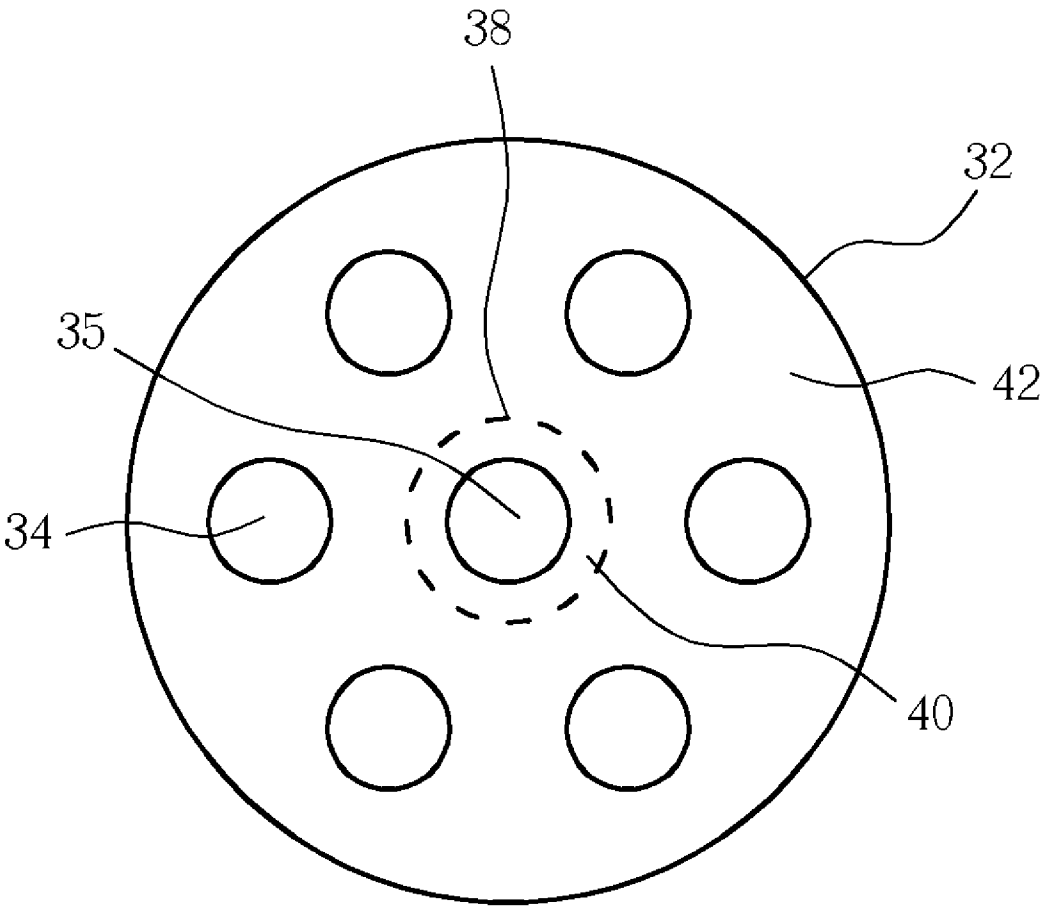
FIG. 7B is a bottom view of the surgical optical system in FIG. 7A.

Please refer to FIGS. 6A and 6B. FIG. 6A is a perspective view of a surgical optical system 30 according to the thirteenth embodiment of the present invention. FIG. 6B is a bottom view of the surgical optical system 30 in FIG. 6A. The surgical optical system 30 comprises a casing 32 and a plurality of light sources 34, 35 installed along an imaginary lower surface 36 of the casing 32. The imaginary lower surface 36 is a plane imaginarily formed by joining bottom ends of the light sources 34, 35. Each of the light sources 34, 35 can be replaced with the light source 10 or the light source 20. The imaginary lower surface 36 of the casing 32 can be a flat surface as shown in FIGS. 6A and 6B, or a substantially flat surface as shown in FIGS. 7A and 7B. Please refer to FIGS. 7A and 7B. FIG. 7A is a perspective view of a surgical optical system 30 according to the fourteenth embodiment of the present invention. FIG. 7B is a bottom view of the surgical optical system 30 in FIG. 7A. In FIGS. 7A and 7B, a first area 40 inside a dashed line 38 where the light source 35 is installed is a flat surface, a second area 42 outside the dashed line 38 where the light sources 34 are installed is a slightly tilted surface.

In FIGS. 6A and 6B, the optical axis of the LED is aligned with the optical axis of the condensing lens for the light source 35. The optical axis of the LED is slightly misaligned with the optical axis of the condensing lens for each of the light sources 34 so that all of the light sources 34, 35 can project light onto substantially the same spot. For example, for the light source 34 to the left of the light source 35, the optical axis of the LED would be slightly to the left of the optical axis of the condensing lens. For the light source 34 to the right of the light source 35, the optical axis of the LED would be slightly to the right of the optical axis of the condensing lens. Since the optical axis of the LED is aligned with the optical axis of the condensing lens, the light source 34 to the left of the light source 35, the light source 34 to the right of the light source 35, and the light source 35 will project light onto a similar area. Since the light sources 34, 35 can project light onto a similar area, a light intensity of a substantial Gaussian distribution can be attained in a target area. After the substantial Gaussian distribution is attained, the dimension of the light field of the substantial Gaussian distribution can be varied by varying the positions of the LEDs, or the condensing lenses of the light sources 34, 35 together.

Besides emitting light with an intensity of a Gaussian distribution, the relative position of the optical axis of the LED and the optical axis of the condensing lens of each light source 34 can be adjusted so as to attain a light intensity of a non-Gaussian distribution in a target area.

In FIGS. 7A and 7B, when the optical axis of the LED is aligned with the optical axis of the condensing lens for each of the light sources 34, 35, a light intensity of a substantial Gaussian distribution may still be attainable if the tilted angle of the second area 42 with respect to the first area 40 is optimized. And the dimension of the light field of the substantial Gaussian distribution can be varied by adjusting the relative distances between the LEDs and the condensing lenses of the light sources 34, 35 together. However if the tilted angle of the second area 42 with respect to the first area 40 is not optimized, then the optical axis of the LED has to be slightly misaligned with the optical axis of the condensing lens for each of the light sources 34 so as to generate light with an intensity of a substantial Gaussian distribution.

Figure 8:
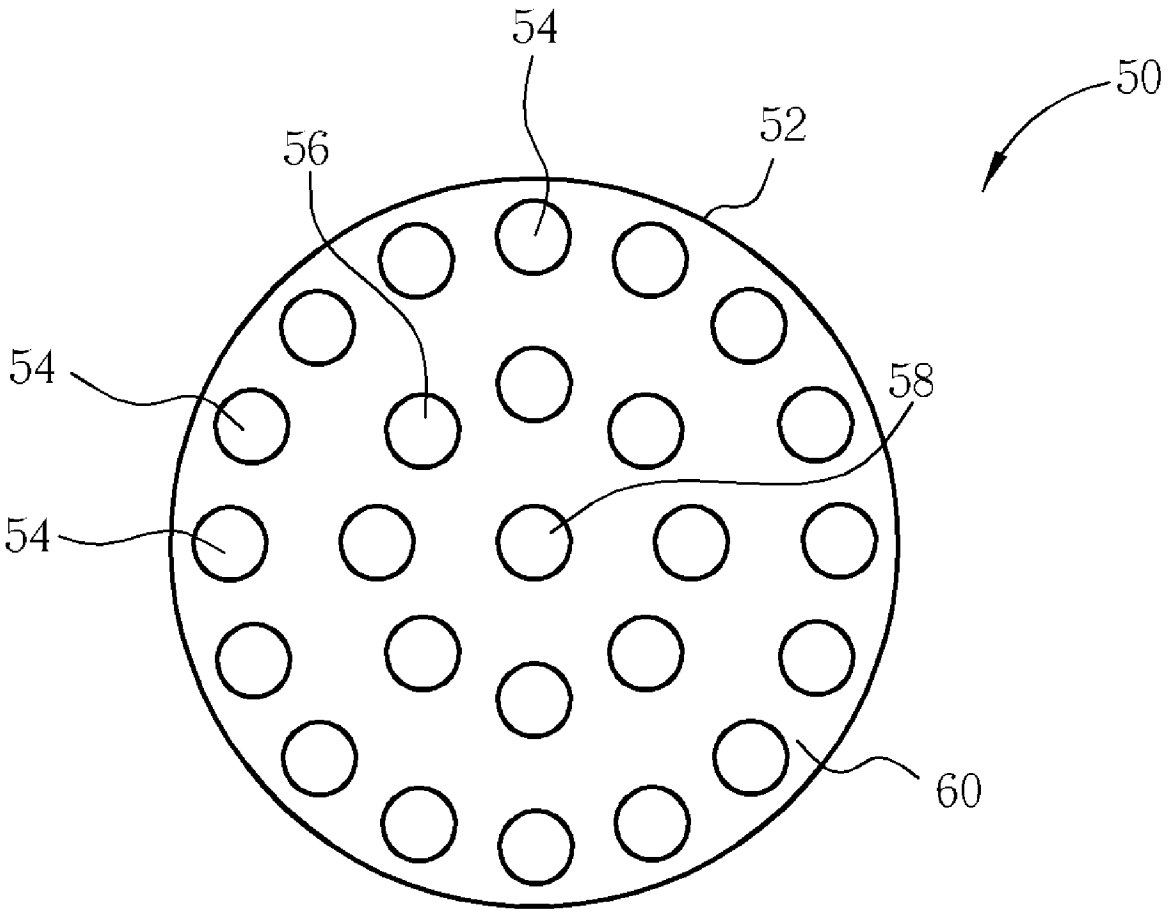
FIG. 8 is a bottom view of a surgical optical system according to the fifteenth embodiment of the present invention.
Figure 9:
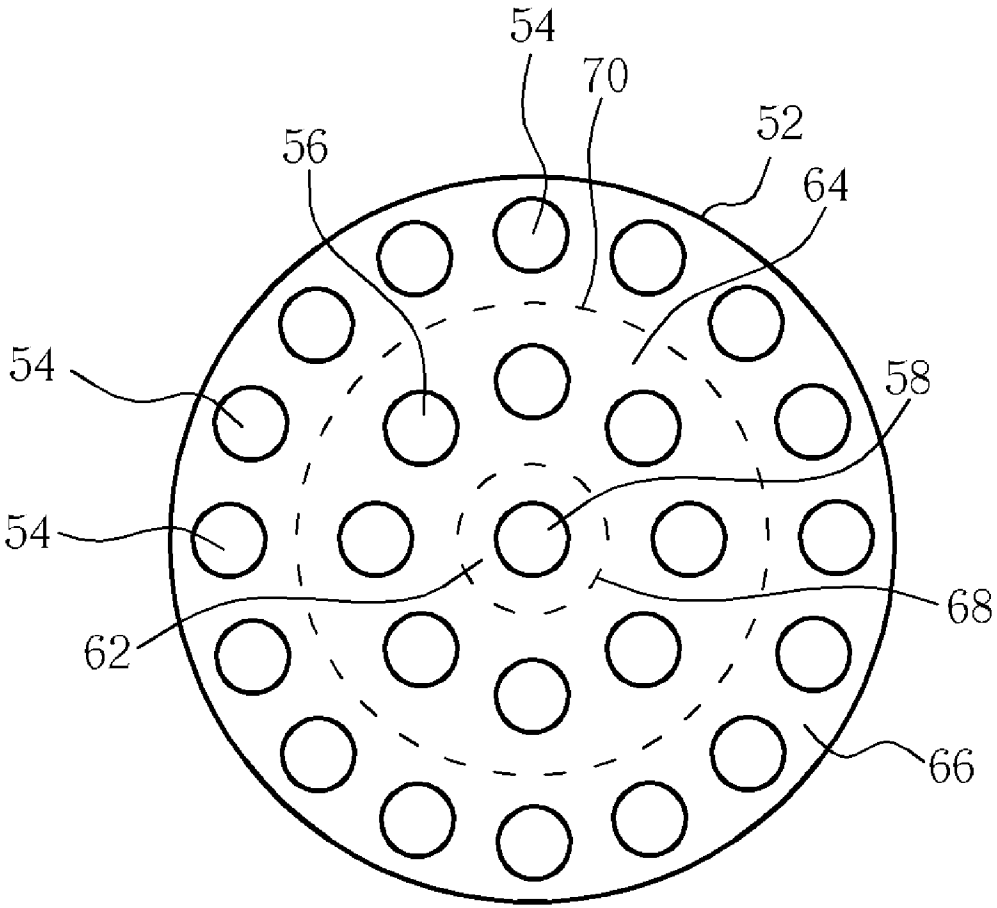
FIG. 9 is a bottom view of a surgical optical system according to the sixteenth embodiment of the present invention.

Please refer to FIG. 8. FIG. 8 is a bottom view of a surgical optical system 50 according to the fifteenth embodiment of the present invention. The surgical optical system 50 comprises a casing 52 and a plurality of light sources 54, 56, 58 installed along an imaginary lower surface 60 of the casing 52. Each of the light sources 54, 56, 58 can be replaced with the light source 10 or the light source 20. The imaginary lower surface 60 of the casing 52 can be a flat surface as shown in FIG. 8, or a substantially flat surface as shown in FIG. 9. FIG. 9 is a bottom view of the surgical optical system 50 according to the sixteenth embodiment of the present invention. In FIG. 9, a first area 62 inside a dashed line 68 where the light source 58 is installed is a flat surface. A second area 64 between the dashed lines 68, 70 where the light sources 56 are installed is a surface slightly tilted with respect to the first area 62. A third area 66 outside the dashed line 70 where the light sources 54 are installed is a surface more severely tilted with respect to the first area 62 than the second area 64. In such an arrangement, a light intensity of a substantial Gaussian distribution can be attained at a target area while the optical axis of the LED is aligned with the optical axis of the condensing lens for each of the light sources 54, 56. However if the tilted angle of the second area 42 with respect to the first area 40 is not optimized, then the optical axis of the LED has to be slightly misaligned with the optical axis of the condensing lens for each of the light sources 34 to generate light with an intensity of a substantial Gaussian distribution.

In FIG. 8, the optical axis of the LED is aligned with the optical axis of the condensing lens for the light source 58. The optical axis of the LED is slightly misaligned with the optical axis of the condensing lens for each of the light sources 56. And the optical axis of the LED is more misaligned with the optical axis of the condensing lens for each of the light sources 54 than for each of the light sources 56 so that all of the light sources 54, 56, 58 can project light onto substantially the same spot. Therefore a light intensity of a substantial Gaussian distribution can be attained at a target area. And the relative distance between the LEDs and the condensing lenses of the light sources 54, 56, 58 can be adjusted together to change the size of the target area.

Figure 10:
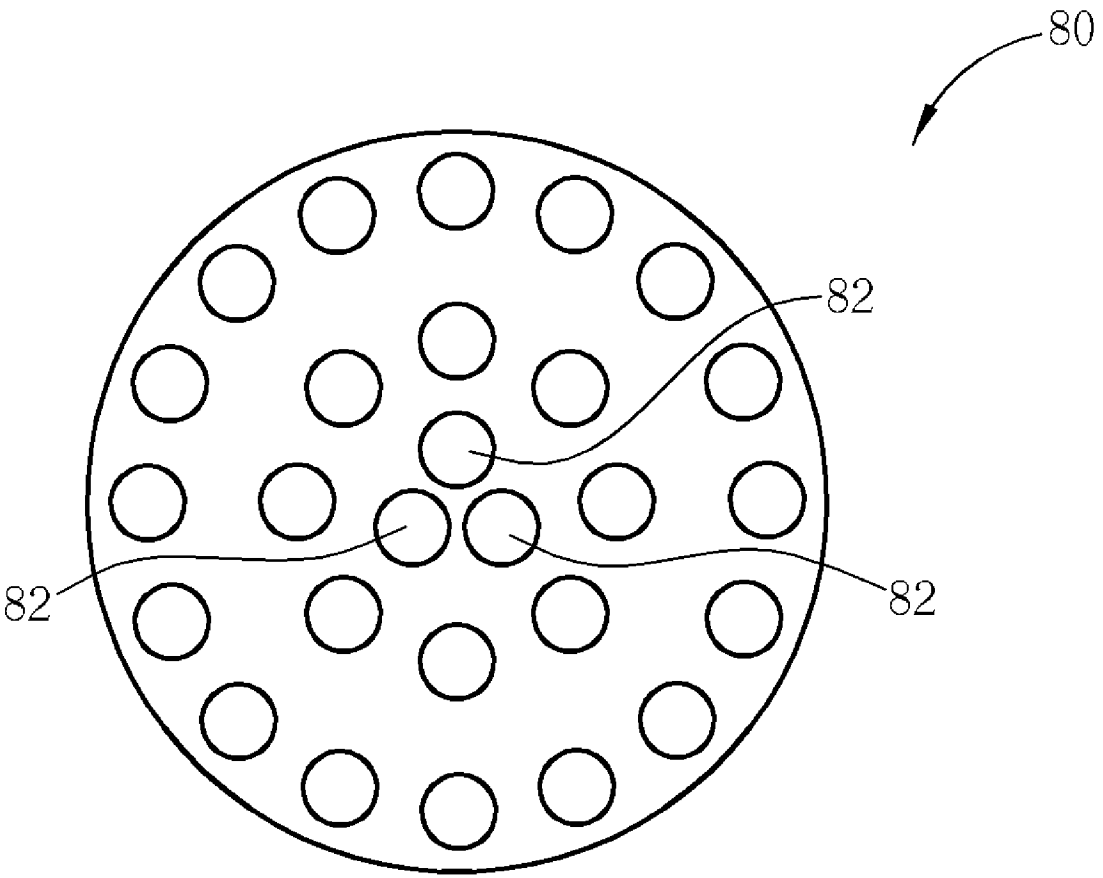
FIG. 10 is a perspective view of a surgical optical system according to the seventeenth embodiment of the present invention.

Please refer to FIG. 10. FIG. 10 is a perspective view of a surgical optical system 80 according to the seventeenth embodiment of the present invention. The surgical optical system 80 differs from the surgical optical system 50 in that the light source 58 is replaced with three light sources 82 encircling a center of the surgical optical system 80. In this case, since the three light sources 82 are sufficiently close to the center of the surgical optical system 80, even if the optical axis of the LED is aligned with the optical axis of the condensing lens for each of the light sources 82, a light intensity of a substantial Gaussian distribution may still be attainable at a target area if the optical axis of the LED is properly misaligned with the optical axis of the condensing lens for each of the light sources 54, 56. However, if a substantial Gaussian distribution cannot be attained, then the optical axis of the LED can be slightly misaligned with the optical axis of the condensing lens for each of the light sources 82 to attain the substantial Gaussian distribution.

In the embodiments shown in FIGS. 6A to 10, the number of light sources is not limited to those shown in the figures. For example, there may be more than or fewer than eight light sources such as five light sources in the second area 64 of FIG. 9, and there may be more than three areas as those shown in FIG. 9. The number of light sources and areas shown in the figures are only for illustration purposes and should not be used to limit the scope of the present invention. Further the distance between the LED and the condensing lens is preferably determined by the distance between the condensing lens and a target object such as a patient. And the extent of misalignment between the optical axis of the LED and the optical axis of the condensing lens for each of the light sources is preferably determined by the distance between the light source and the center of the surgical optical system. Preferably, the extent of misalignment shown as $\Delta x$ in FIG. 2 is within 0.5 mm, and the adjustable range shown as $\Delta y$ in FIG. 2 between the LED and the condensing lens is 1 mm. The distance between the light sources such as the light source 10 and a target area is about 1 meter.

Figure 11:
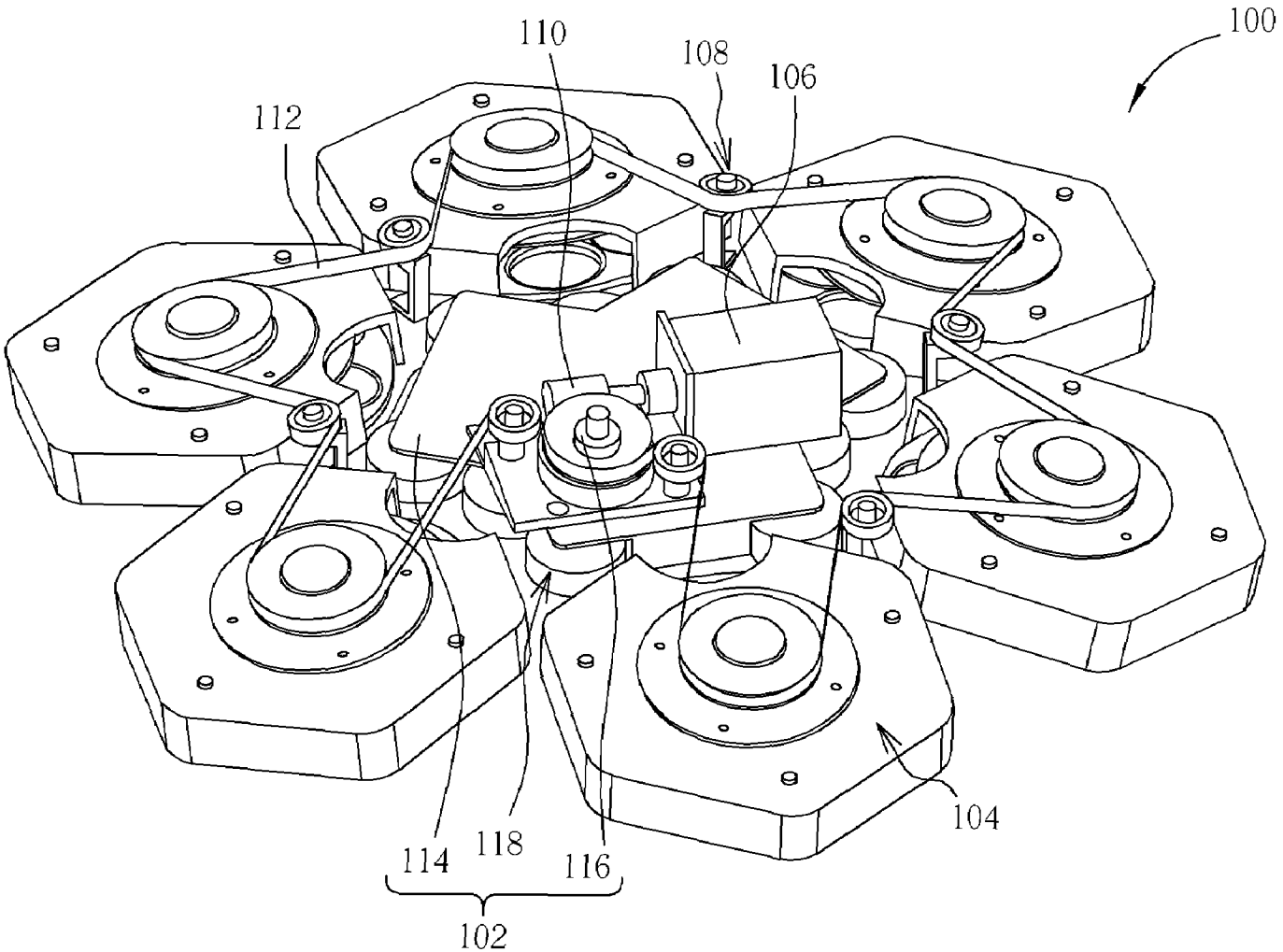
FIG. 11 is a perspective view of an operating lamp according to the eighteenth embodiment of the present invention.

Please refer to FIG. 11. FIG. 11 is a perspective view of an operating lamp 100 according to the eighteenth embodiment of the present invention. The operating lamp 100 comprises a center optical system 102, a plurality of side optical systems 104, a motor 106, a plurality of third pulleys 108, a gear wheel 110 mounted on the motor 106, and a gear belt 112. The center optical system 102 comprises a first casing 114, a first pulley 116 installed on the first casing 114, and a plurality of light sources 118 accommodated in the first casing 114.

Figure 12:
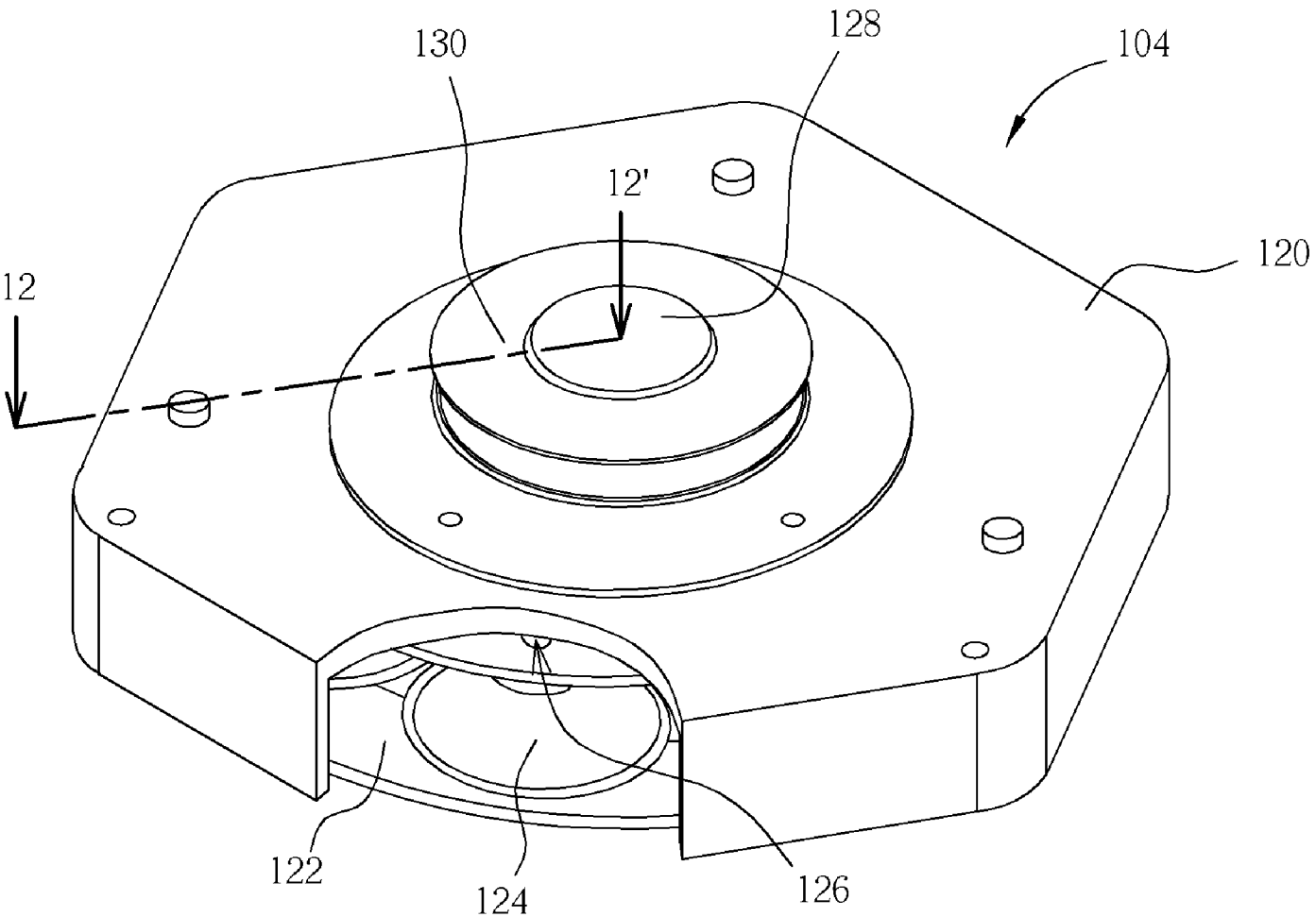
FIG. 12 is a perspective view of one of the side optical systems in FIG. 11.
Figure 13:
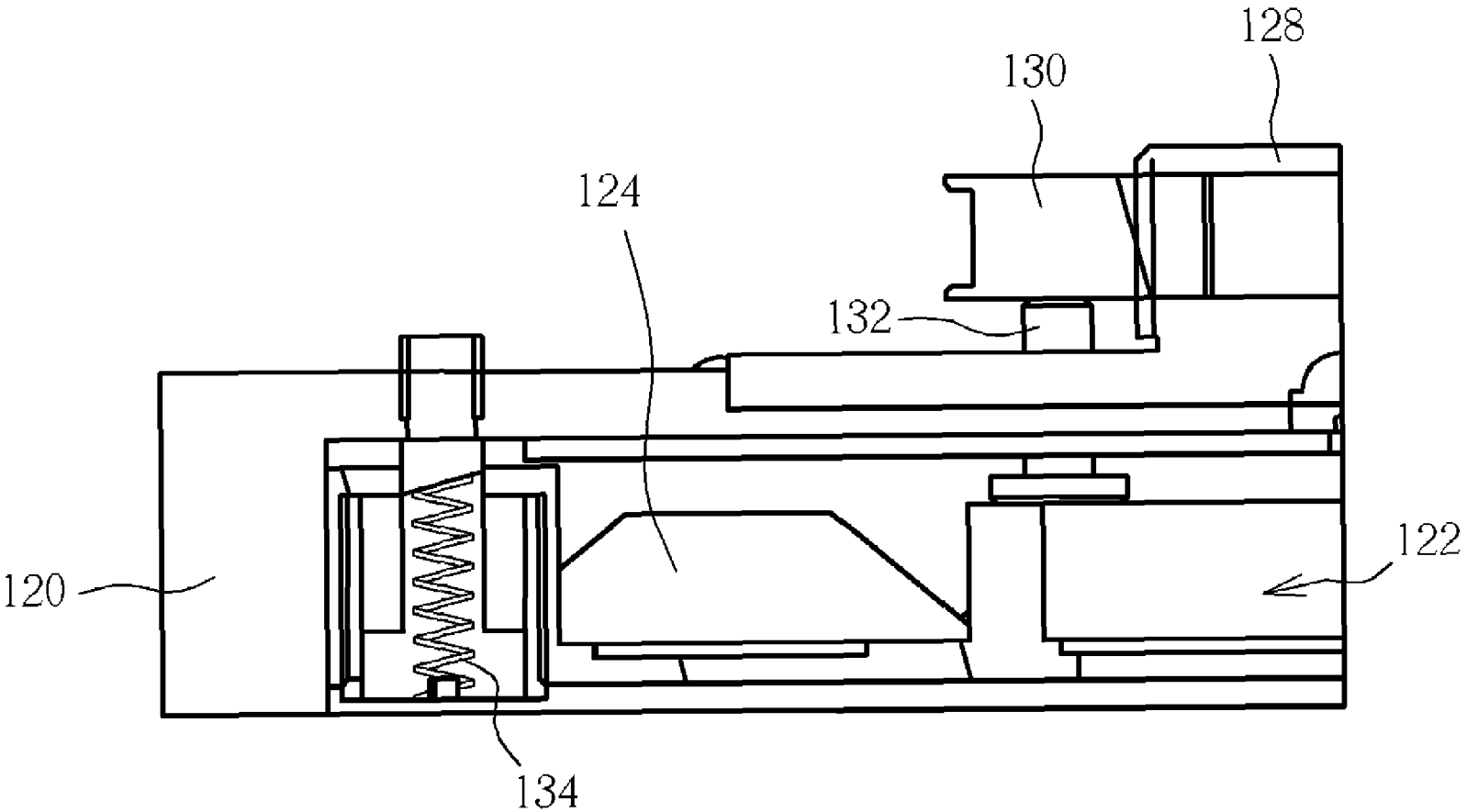
FIG. 13 is a cross-sectional view of the side optical system in FIG. 12 along a cross-sectional line 12-12'.

Next, please refer to FIG. 12. FIG. 12 is a perspective view of one of the side optical systems 104 in FIG. 11. Each of the plurality of side optical systems 104 comprises a second casing 120, a disk body 122, a plurality of condensing lenses 124, and a plurality of LEDs 126. The second casing 120 is fixed on the first casing 114. The disk body 122 is movably accommodated in the second casing 120. The plurality of condensing lenses 124 is fixed on the disk body 122 for moving together with the disk body 122. The plurality of LEDs 126 is disposed above the plurality of condensing lenses 124 respectively and fixed on the second casing 120. Next, please refer to FIG. 13. FIG. 13 is a cross-sectional view of the side optical system 104 along a cross-sectional line 12-12' in FIG. 12. As shown in FIG. 13, each of the plurality of side optical systems 104 further comprises a lead screw 128, a second pulley 130, a rod 132, and a spring 134. The lead screw 128 is connected to the second casing 120 in a coaxial manner. The second pulley 130 is meshed with the lead screw 128 for moving downward or upward on the lead screw 128 when the second pulley 130 is rotated by the gear belt 112. The rod 132 abuts against the disk body 122 and the second pulley 130 for pushing the disk body 122 to move downward when the second pulley 130 is rotated downward on the lead screw 128. The spring 134 is connected to the second casing 120 and the disk body 122 for pulling the disk body 122 to move upward when the second pulley is rotated upward on the lead screw 128.

Next, please refer to FIG. 11 and FIG. 13 at the same time. As shown in FIG. 11, the motor 106 is mounted on the first casing 114. The gear wheel 110 is mounted on the motor 106 and disposed next to the first pulley 116 for meshing with the first pulley 116. The gear belt 112 is disposed along the first pulley 116, second pulleys 130 of side optical systems 104 and third pulleys 108 for causing each disk body 122 of side optical systems 104 to move upward or downward with the corresponding second pulley 130 simultaneously when the motor 106 drives the gear wheel 110. Take the side optical system 104 shown in FIG. 12 for example. When the motor 106 drives the gear wheel 110 to rotate the first pulley 116, the second pulley 130 is rotated accordingly by the gear belt 112. Subsequently, the second pulley 130 shown in FIG. 13 moves downward or upward on the lead screw 128 since the second pulley 130 is meshed with the lead screw 128. That is to say, when the second pulley 130 is rotated downward on the lead screw 128, the second pulley 130 pushes the rod 132 to move the disk body 122 downward so that the plurality of condensing lenses 124 fixed on the disk body 122 move downward with the disk body 122 simultaneously. When the second pulley 130 is rotated upward on the lead screw 128, the spring 134 pulls the disk body 122 upward so that the plurality of condensing lenses 124 move upward with the disk body 122 simultaneously. In such a manner, the present invention can adjust the locations of the condensing lenses 124 relative to the corresponding LEDs 126 by rotating the second pulleys 130. Characteristics and corresponding configurations of the center optical system 102, side optical systems 104, the condensing lenses 124 and the LEDs 126 are the same as mentioned above. Thus, the detail description thereof is omitted for the sake of convenience and simplicity.

Figure 14:
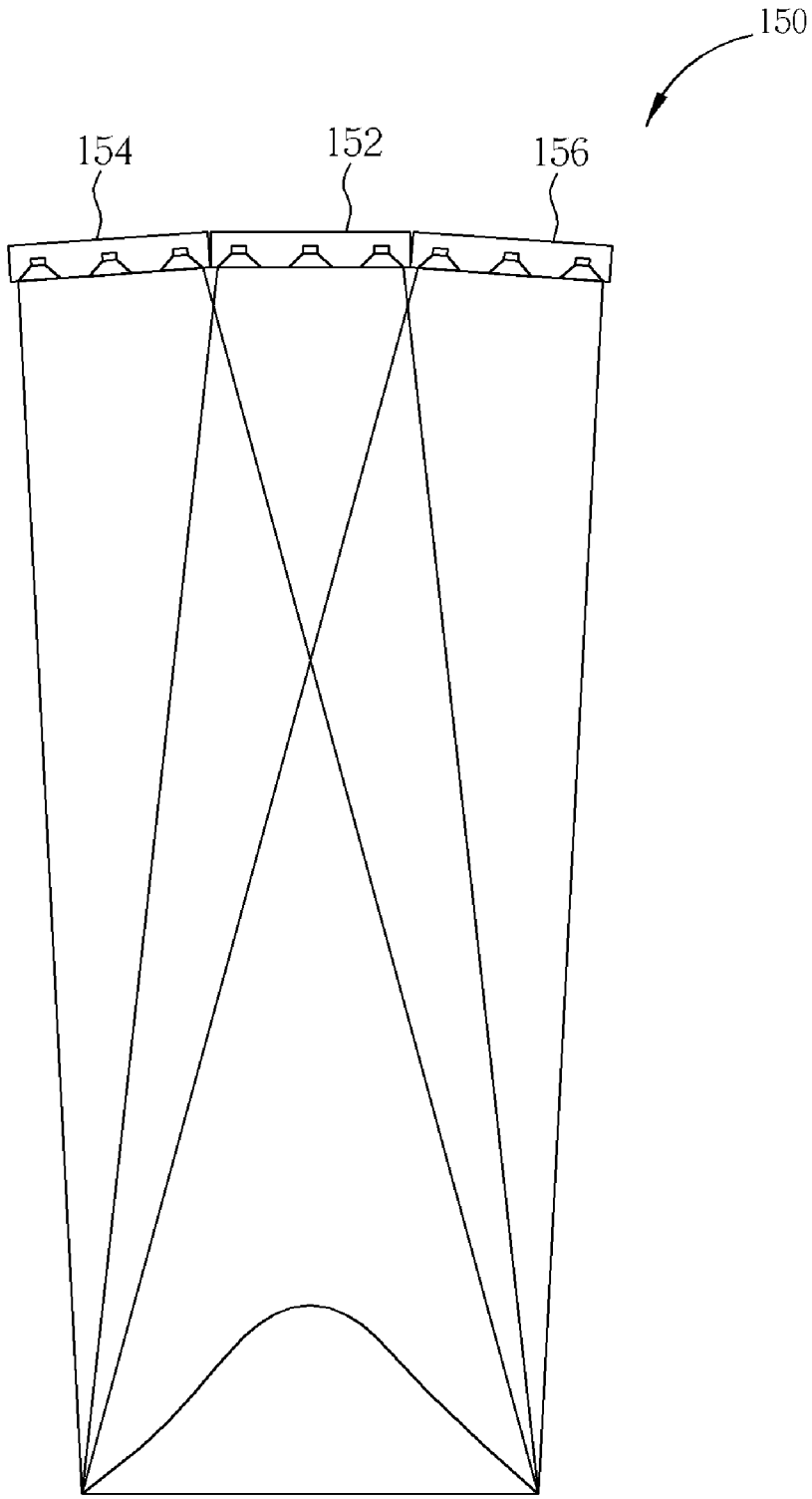
FIGS. 14 and 15 are perspective views of operating lamps respectively according to the nineteenth and twentieth embodiments of the present invention.
Figure 15:
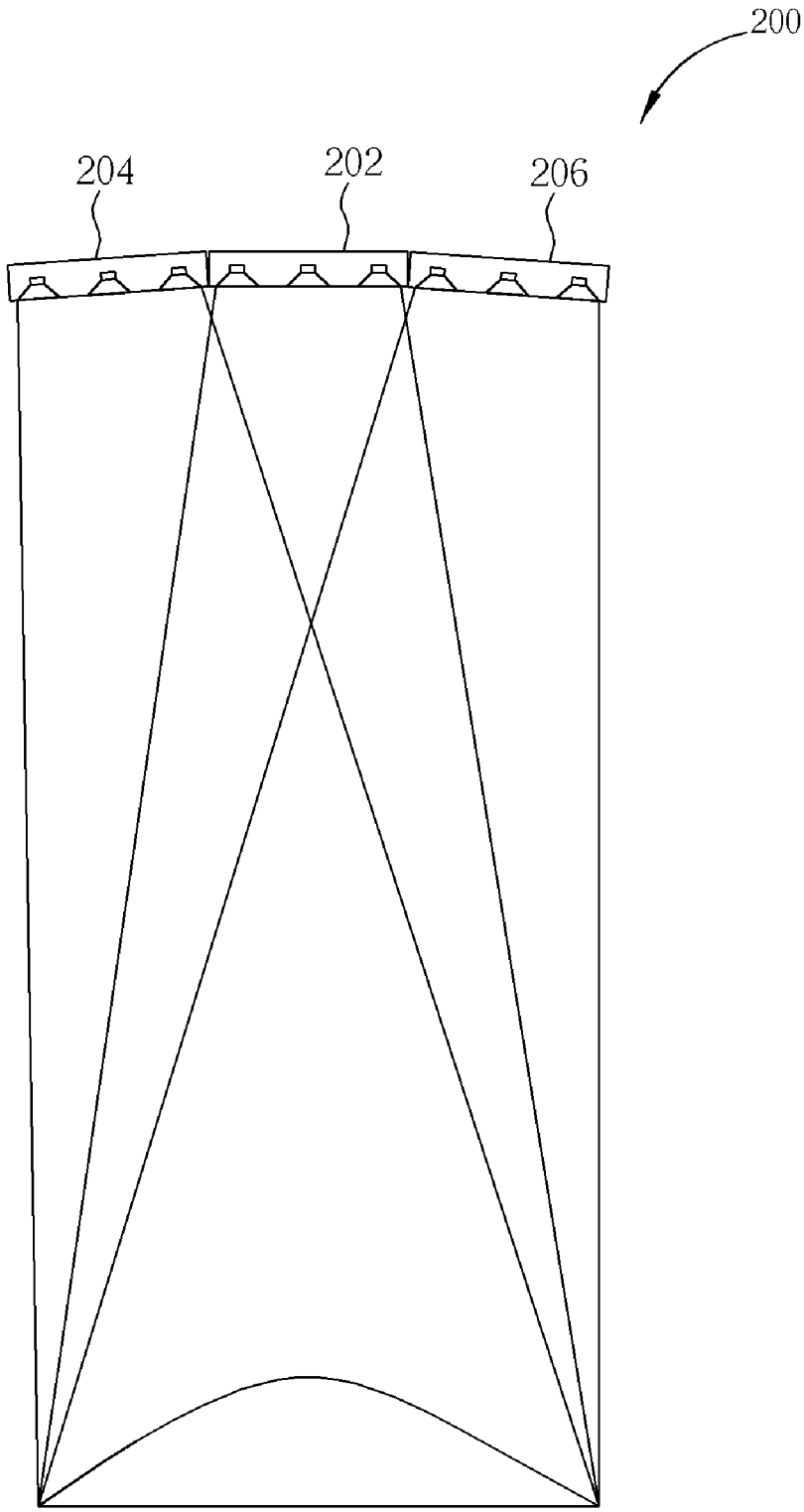

Finally, please refer to FIGS. 14 and 15. FIGS. 14 and 15 are perspective views of operating lamps 150, 200 respectively according to the nineteenth and twentieth embodiments of the present invention, both including seven surgical optical systems emitting light onto similar target areas though only three are shown in each of FIGS. 14 and 15. Of the seven surgical optical systems in FIG. 14, six are equally spaced and encircling the surgical optical system 152. Of the seven surgical optical systems in FIG. 15, six are equally spaced and encircling the surgical optical system 202. The substantial Gaussian distribution in FIG. 14 has a smaller light field than the substantial Gaussian distribution in FIG. 15. But the light intensity in the light field of FIG. 14 is greater than that of FIG. 15. The differences are caused by different relative positions of LEDs and corresponding condensing lenses of the operating lamps 150, 200. In these embodiments, the surgical optical systems 152, 154, 156 are identical. The surgical optical systems 202, 204, 206 are identical. In order to project light onto a similar target area in FIG. 14, the surgical optical systems 154, 156 are slanted, same as the surgical optical systems 204, 206 in FIG. 15.

Further, the adjustment of misalignment between the LED and the condensing lens is preferably performed for all light sources of a surgical optical system together. Moreover, the light sources mentioned above can be used in other fields other than surgical usage. Also, the surgical optical systems mentioned above can be used in places other than a surgery. As long as an apparatus utilizes a light source with an adjustable LED or condensing lens, the apparatus is within the scope of the present invention.

As mentioned above, the present invention involves adjusting a position of an LED relative to a condensing lens in a light source of an operating lamp to expand a light field emitted from the operating lamp. Compared with the prior art, the present invention can not only adjust the size of the light field, but can provide the light field with a light intensity of a substantial Gaussian distribution in a target area even if the size of the light field is changed. Thus the light intensity corresponding to the center of the operating lamp can still be maximized even when the light field is enlarged or reduced.

Those skilled in the art will readily observe that numerous modifications and alterations of the device and method may be made while retaining the teachings of the invention.

What is claimed is:

1. An operating lamp comprising:

a center optical system comprising:

a first casing;

a first pulley installed on the first casing; and a plurality of light sources accommodated in the first casing;

a plurality of side optical systems each comprising:

a second casing fixed on the first casing;

a disk body movably accommodated in the second casing;

a plurality of condensing lenses fixed on the disk body for moving together with the disk body;

a plurality of light emitting diodes (LEDs) disposed above the plurality of condensing lenses respectively and fixed on the second casing;

a lead screw connected to the second casing in a coaxial manner;

a second pulley meshed with the lead screw for moving downward or upward on the lead screw when rotated;

a rod abutting against the disk body and the second pulley for pushing the disk body to move downward when the second pulley is rotated downward; and a spring connected to the second casing and the disk body for pulling the disk body to move upward when the second pulley is rotated upward;

a motor mounted on the first casing;

a plurality of third pulleys;

a gear wheel mounted on the motor and disposed next to the first pulley for meshing with the first pulley; and a gear belt disposed along the first pulley, second pulleys of side optical systems and third pulleys for meshing with the first pulley and the second pulleys and engaging with the third pulleys for causing each disk body to move upward or downward with the corresponding second pulley when the motor drives the gear wheel.

2. The operating lamp of claim 1 wherein the third pulleys are installed on the first casing.

3. The operating lamp of claim 1 wherein each of the condensing lenses is a collimator.

4. The operating lamp of claim 1 wherein each of the condensing lenses is a positive lens.

5. The operating lamp of claim 4 wherein the positive lens is a biconvex lens, a plano-convex lens, or a positive meniscus lens.

6. The operating lamp of claim 1 wherein each of the LEDs is disposed approximately at a focus of a corresponding condensing lens.

7. The operating lamp of claim 1 wherein second casings of the side optical systems are symmetrically tilted with respect to the first casing.

8. The operating lamp of claim 1 wherein a plurality of LEDs of each side optical system are symmetrically tilted with respect to a center axis of the second casing.

9. The operating lamp of claim 1 wherein a plurality of condensing lenses of each side optical system are symmetrically tilted with respect to a center axis of the second casing.

10. The operating lamp of claim 1 wherein a plurality of light sources of the center optical system are symmetrically tilted with respect to a center axis of the first casing.

11. The operating lamp of claim 1 wherein optical axes of a plurality of LEDs of each side optical system are misaligned with optical axes of corresponding condensing lenses symmetrically with respect to a center axis of the second casing.

12. The operating lamp of claim 1 wherein each of the light sources of the center optical system comprises an LED and a condensing lens.

13. The operating lamp of claim 12 wherein optical axes of a plurality of LEDs of the center optical system are misaligned with optical axes of corresponding condensing lenses symmetrically with respect to a center axis of the first casing.

* * * * *